US007631381B2

(12) United States Patent
Flippin

(10) Patent No.: US 7,631,381 B2
(45) Date of Patent: Dec. 15, 2009

(54) MATTRESS HAVING FOAM ENCASEMENT AND METHOD OF MAKING THE SAME

(75) Inventor: James Patrick Flippin, Chapel Hill, NC (US)

(73) Assignee: Kingsdown, Incorporated, Mebane, NC (US)

( * ) Notice: Subject to any disclaimer, the term of this patent is extended or adjusted under 35 U.S.C. 154(b) by 0 days.

(21) Appl. No.: 11/577,141

(22) PCT Filed: Oct. 11, 2005

(86) PCT No.: PCT/US2005/036137

§ 371 (c)(1),
(2), (4) Date: May 16, 2007

(87) PCT Pub. No.: WO2006/044245

PCT Pub. Date: Apr. 27, 2006

(65) Prior Publication Data

US 2008/0295251 A1 Dec. 4, 2008

Related U.S. Application Data

(60) Provisional application No. 60/617,079, filed on Oct. 12, 2004.

(51) Int. Cl.
*B68G 7/00* (2006.01)
*A47C 27/00* (2006.01)

(52) U.S. Cl. ..... 5/739; 5/721; 5/696; 29/91.1

(58) Field of Classification Search ..... 5/739, 5/740, 696, 721; 29/91.1, 91.2, 91.5, 91.6
See application file for complete search history.

(56) References Cited

U.S. PATENT DOCUMENTS

| | | | | |
|---|---|---|---|---|
| 2,326,441 | A | 8/1943 | Cunningham | |
| 3,733,657 | A | 5/1973 | Lankton | |
| 3,790,972 | A * | 2/1974 | Lehmann | 5/721 |
| 3,906,560 | A * | 9/1975 | Bulloch, Jr. | 5/721 |
| 5,138,730 | A | 8/1992 | Masuda | |
| 6,098,224 | A | 8/2000 | Gladney | |
| 6,212,720 | B1 | 4/2001 | Antinori et al. | |
| 6,578,220 | B1 * | 6/2003 | Smith | 5/740 |
| 6,874,215 | B2 | 4/2005 | Flippin | |
| 7,165,282 | B2 * | 1/2007 | Watson | 5/739 |
| 7,185,379 | B2 * | 3/2007 | Barman | 5/717 |
| 7,240,382 | B2 * | 7/2007 | Berrocal et al. | 5/408 |
| 7,251,847 | B2 * | 8/2007 | Wells | 5/716 |
| 7,424,762 | B2 * | 9/2008 | Wright et al. | 5/717 |
| 2003/0000021 | A1 * | 1/2003 | O'Connell et al. | 5/739 |
| 2004/0194270 | A1 * | 10/2004 | Flippin | 29/91.1 |
| 2005/0000026 | A1 * | 1/2005 | Gladney | 5/717 |

* cited by examiner

*Primary Examiner*—Michael Trettel
(74) *Attorney, Agent, or Firm*—Shoemaker and Mattare

(57) ABSTRACT

A mattress core unit, such as an innerspring, is placed inside a foam envelope, which in turn is covered with fabric. The side and end rails of the envelope overlap the bottom panel, to provide good support for all edges of the mattress. The top panel of the envelope overlaps the side and end rails. To make a reversible mattress, an overlapping bottom foam panel is used. The method simplifies matress construction, reduces the number of required stock keeping units, and provides a comfortable, yet firm, feel at the edges of the mattress.

10 Claims, 18 Drawing Sheets

MATTRESS HAVING FOAM ENCASEMENT AND METHOD OF MAKING THE SAME

This application claims benefit of provisional U.S. application No. 60/617079, filed Oct. 12, 2004.

BACKGROUND OF THE INVENTION

This invention relates to a mattress having a core which is completely encased in resilient foam insulation.

In conventional mattress construction, a mattress core such as a metal innerspring unit—usually having an array of parallel coil springs surrounded top and bottom by respective border wires which define the edges of the mattress—is covered with padding and fabric. The word "fabric", as used herein, means any flexible material made of yarns or fibers, including woven materials, knit materials, and non-woven materials such as spun-bond material and the like made from bonded or interlocked fibers. The yarns or fibers may be natural or synthetic. Non-fibrous padding, which often is a polymeric foam, is commonly called "insulation".

Some of the insulation is usually secured to the border wires, or to the coil springs, by metal connectors such as hog rings which are passed through the material and crimped around the underlying metal component. Other insulation layers may be attached at least temporarily by the adhesives. The insulation layers are ultimately covered and secured in place by a fabric material which conceals the other components and presents a finished appearance.

Traditional mattresses are symmetrical (same top and bottom) and are expected to be inverted occasionally to distribute wear and tear and maximize comfort. Another type of mattress, which has recently gained popularity, is the so-called "one-sided" mattress. A one-sided mattress is intended not to be turned and in fact has only one comfortable side on which one can sleep. The other side may have a fabric, or thinly padded, covering. The one-sided mattress is an advantage for customers who prefer not to turn mattresses.

Most mattresses are not thickly padded at the sides. This can result in a harsh-feeling edge near where the border wires pass. Some prior inventors have proposed constructing a foam "tray" or envelope to contain the innerspring. An advantage of thick insulation is that it looks better when upholstered, and is capable of providing good vertical support. However, placing thick foam at the upper edges of the mattress can produce edges which are perceived as weak or unstable when sat upon.

SUMMARY OF THE INVENTION

An object of the invention is to simplify the construction of a mattress.

Another object is to provide a mattress having a padded, yet well-supported edge.

These and other objects are attained by a mattress having foam encasement as described below.

BRIEF DESCRIPTION OF THE DRAWINGS

In the accompanying drawings, FIG. 1 shows a first step of a method for constructing a mattress;

FIG. 2 shows a second step of the method;

FIG. 3 shows a third step of the method;

FIG. 4 shows a fourth step of the method;

FIG. 5 shows a fifth step of the method;

FIG. 6 shows a sixth step of the method;

FIG. 7 shows a seventh step of the method;

FIG. 8 shows an eighth step of the method;

FIG. 9 shows a ninth step of the method;

FIG. 10 shows a tenth step of the method;

FIG. 11 shows an eleventh step of the method;

FIG. 12 shows a first step of the method;

FIG. 13 shows a second step of the method;

FIG. 14 shows a third step of the method;

FIG. 15 shows a fourth step of the method;

FIG. 16 shows a fifth step of the method; and

FIG. 17 show a sixth step of the method.

DESCRIPTION OF THE PREFERRED EMBODIMENT

A mattress embodying the invention is built around a mattress core. The core may be an innerspring unit, comprising an array of coil springs, which may bounded by upper and lower border wires. It should be understood, however, that the invention is equally applicable to constructions having another type of mattress core, for example, a block of firm foam, or an air bladder.

Whatever its type, the mattress core is encased, according to this invention, in a resilient foam envelope. The envelope preferably is constructed from a peripheral foam wall made of two foam side rails and two foam end rails which are connected to one another so as to frame a bottom foam panel. After the core unit is inserted, a foam top panel completes the envelope.

The side rails preferably overlap the end rails to minimize the required number of stock keeping units. We presently prefer to use two-inch thick (5.1 cm) stock material for the bottom panel and the side rails, and three-inch (7.6 cm) thick material for the end rails. However, it should be understood that other thicknesses may be used, and in fact an advantage of this invention is that mattresses of non-standard dimensions may be made simply by increasing or decreasing, within limits, the thickness of the rails. This can reduce the number of different innerspring sizes that have to be kept in stock.

Figure 1:
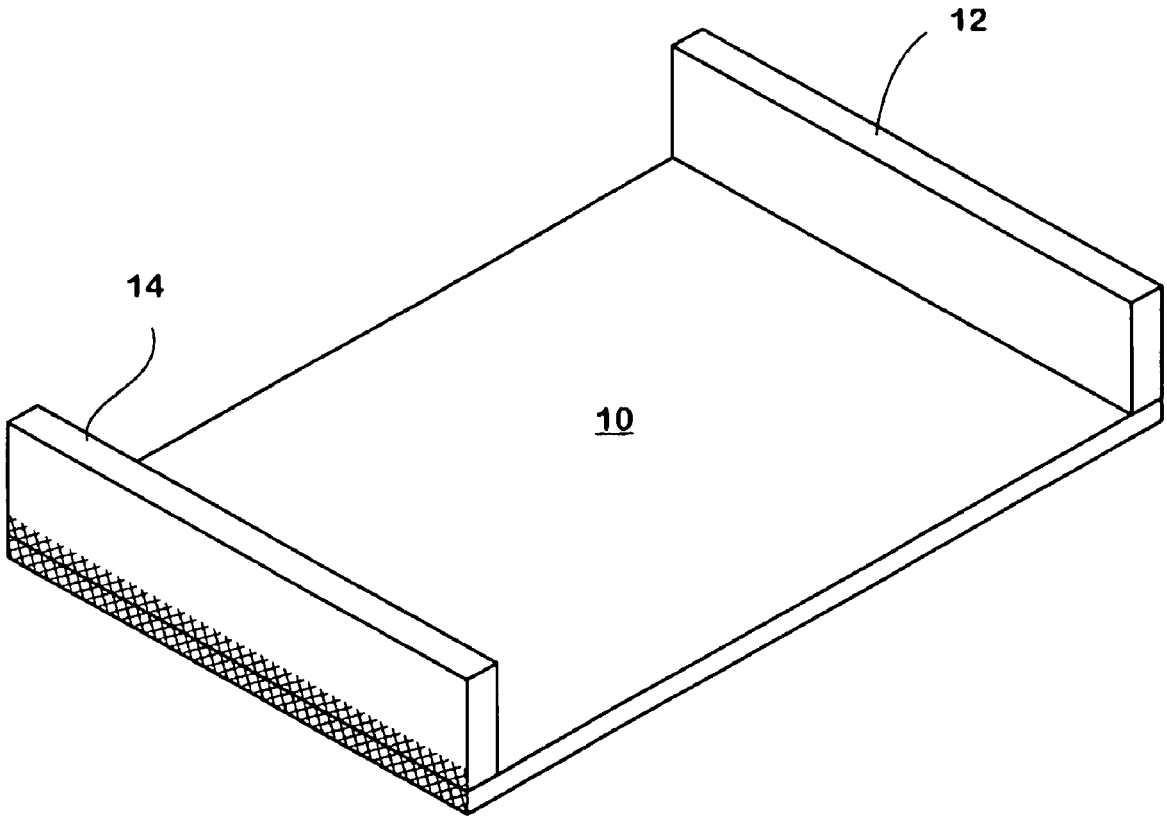
FIGS. 1-11 are simplified perspective views showing a sequence of steps in a process for making a mattress according to this invention. In particular.
Figure 2:
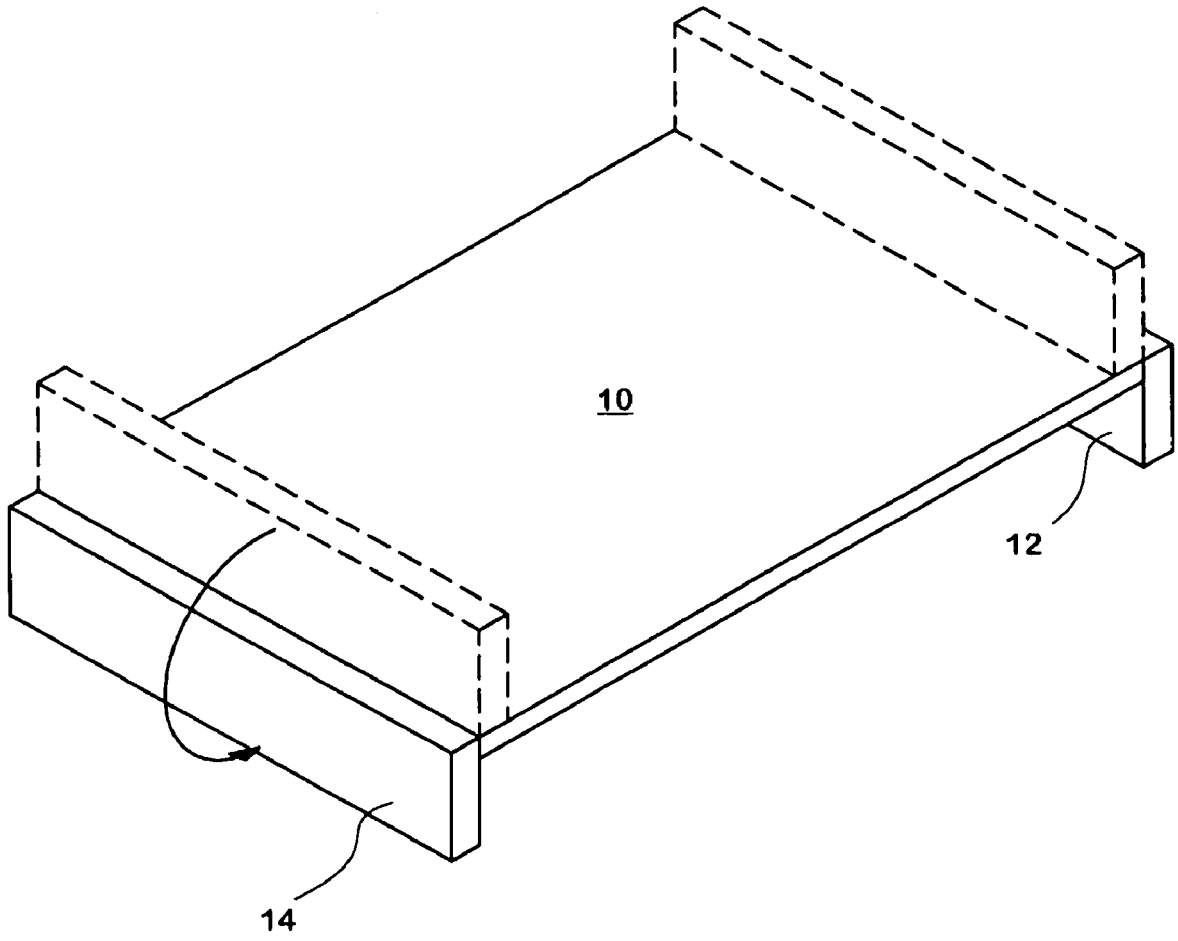
Figure 3:
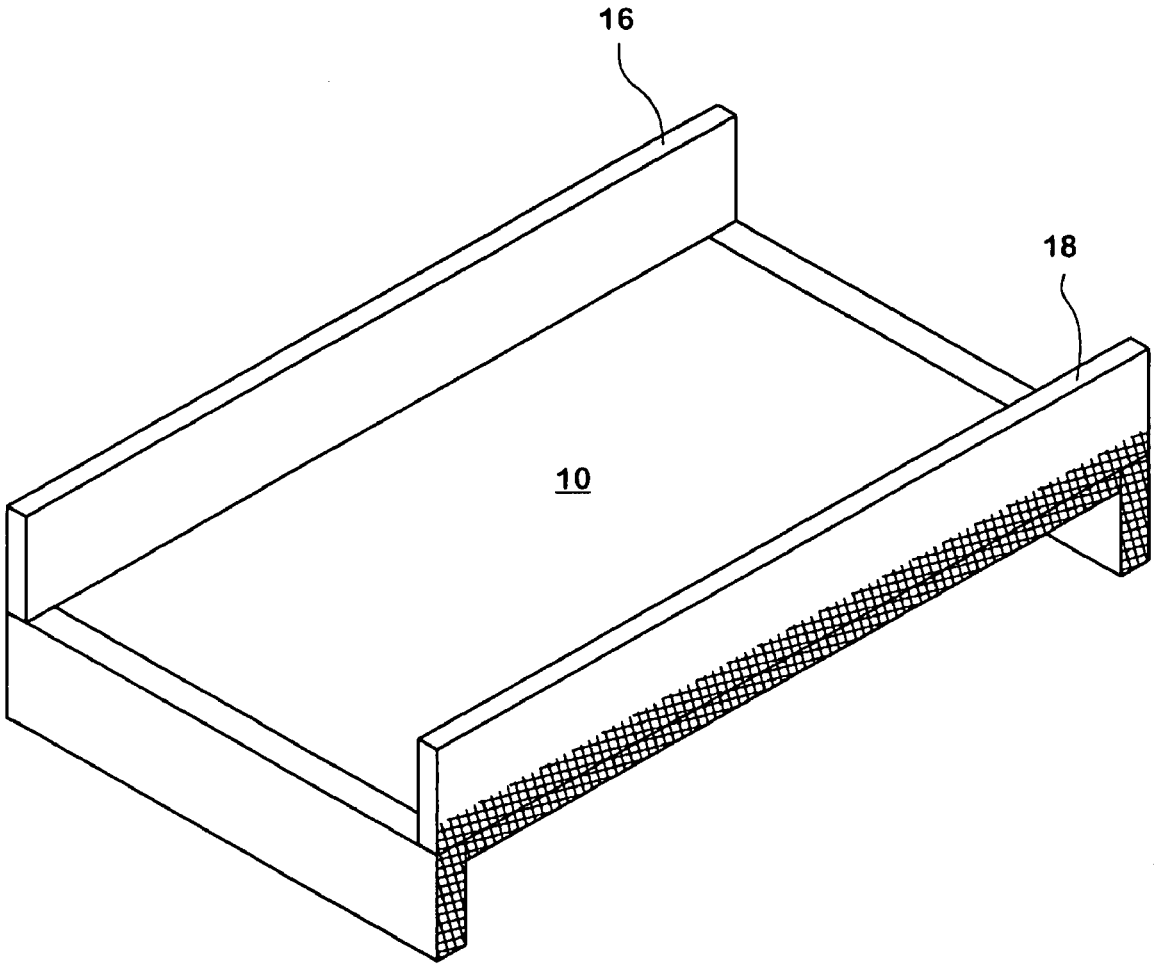
Figure 4:
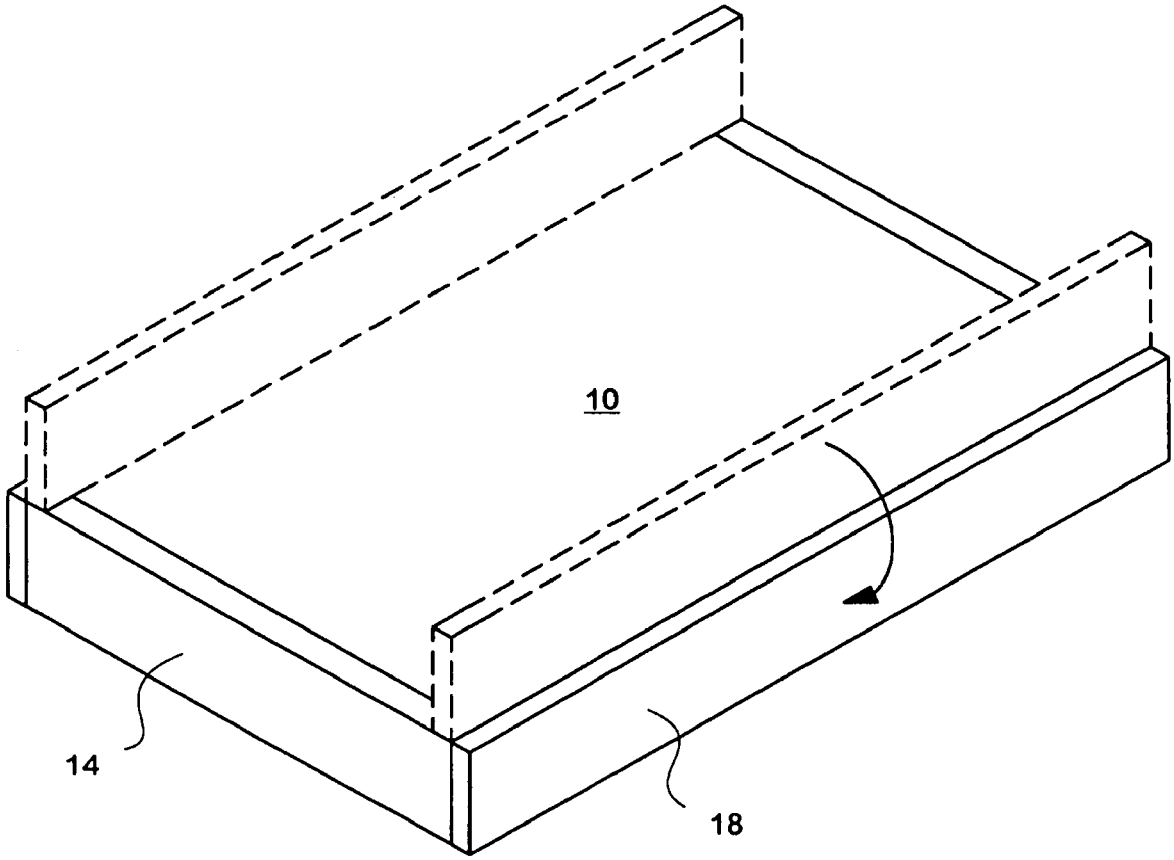

FIG. 1 shows a first step in the construction of the mattress. A bottom foam panel 10 is placed on a work surface, and then a pair of end rails 12, 14 are placed on top of the bottom panel their end surfaces being aligned coplanar with the end surfaces of the bottom panel. Now the operator coats the coplanar surfaces of the end rail and the bottom layer, in the region shown by hatching, with a foam adhesive, using a suitable applicator such as a spray gun. Next, (FIG. 2), he pivots the end rail downward 180° so that the adhesive coatings on the respective parts meet and promptly bind the pieces together. This process is repeated for the other end rail. In a next step (FIG. 3) the side rails 16, 18 are placed on top of the bottom panel, their side surfaces being aligned with those of the bottom panel. Adhesive is applied to the coplanar surfaces of the bottom panel and the side rails, and also to the ends of the end rails, as shown by the hatching, and then the side rails are pivoted downward (FIG. 4) so that the coated surfaces adhere, forming a tub 20.

Figure 5:
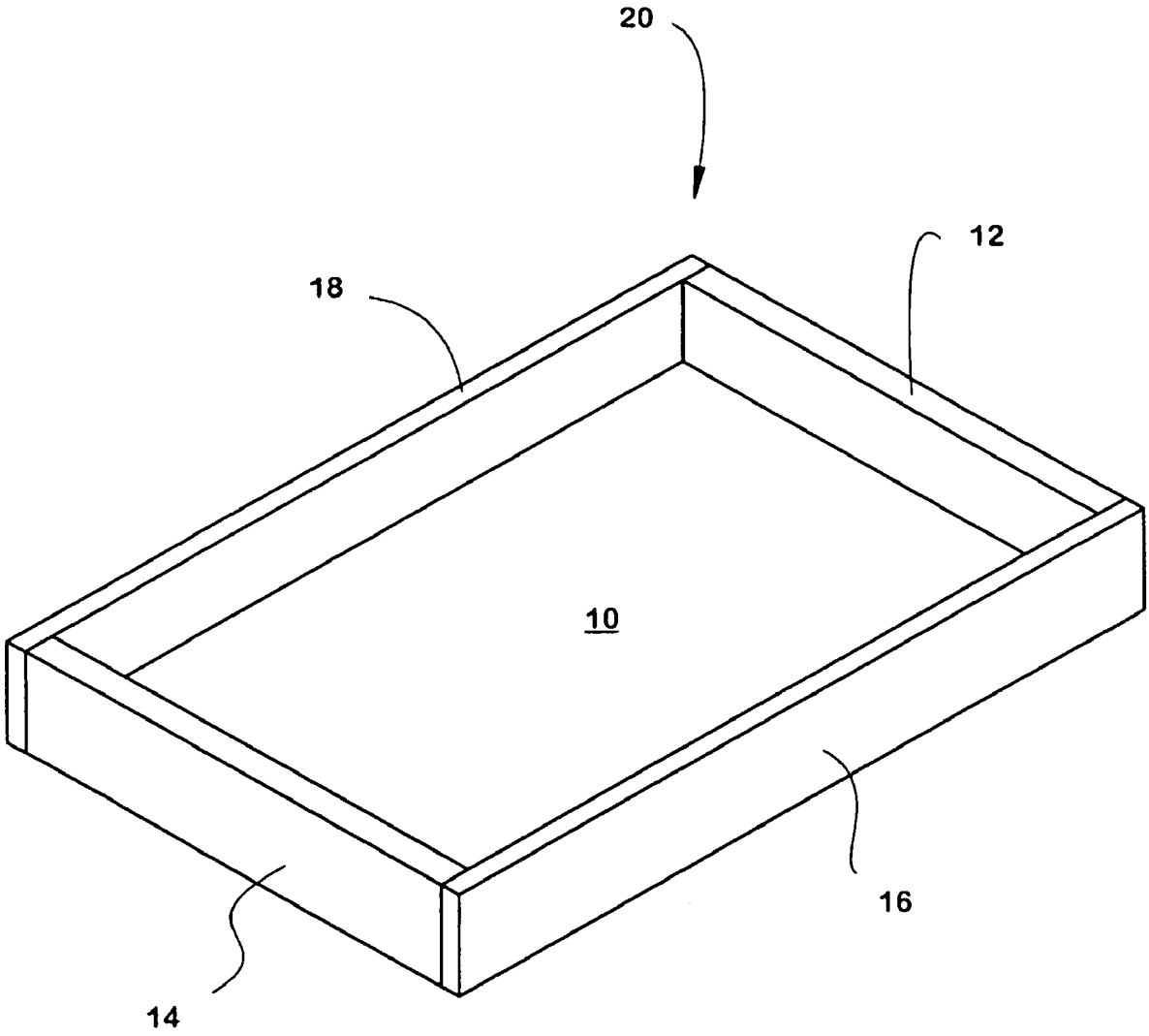
Figure 6:
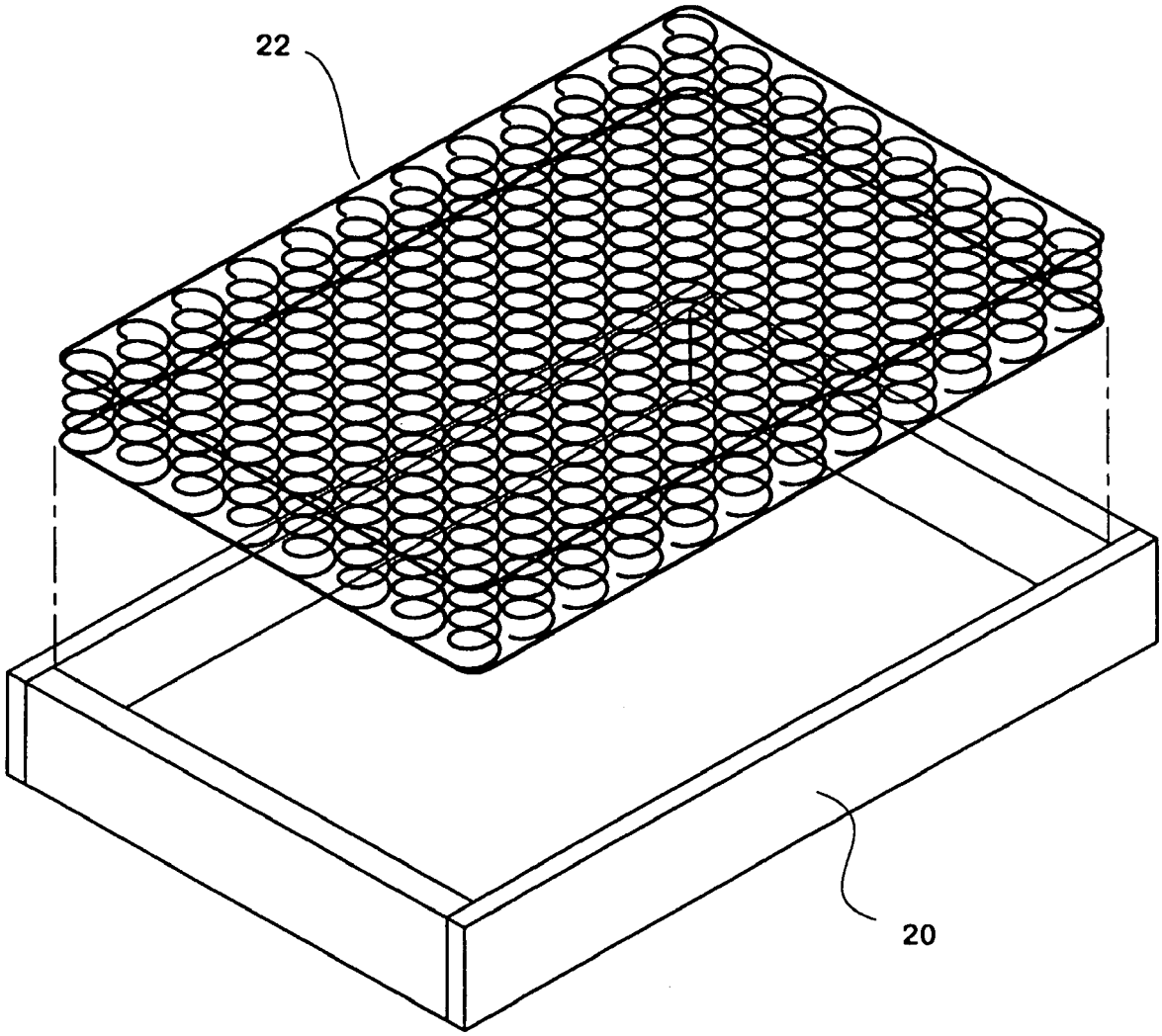
Figure 7:
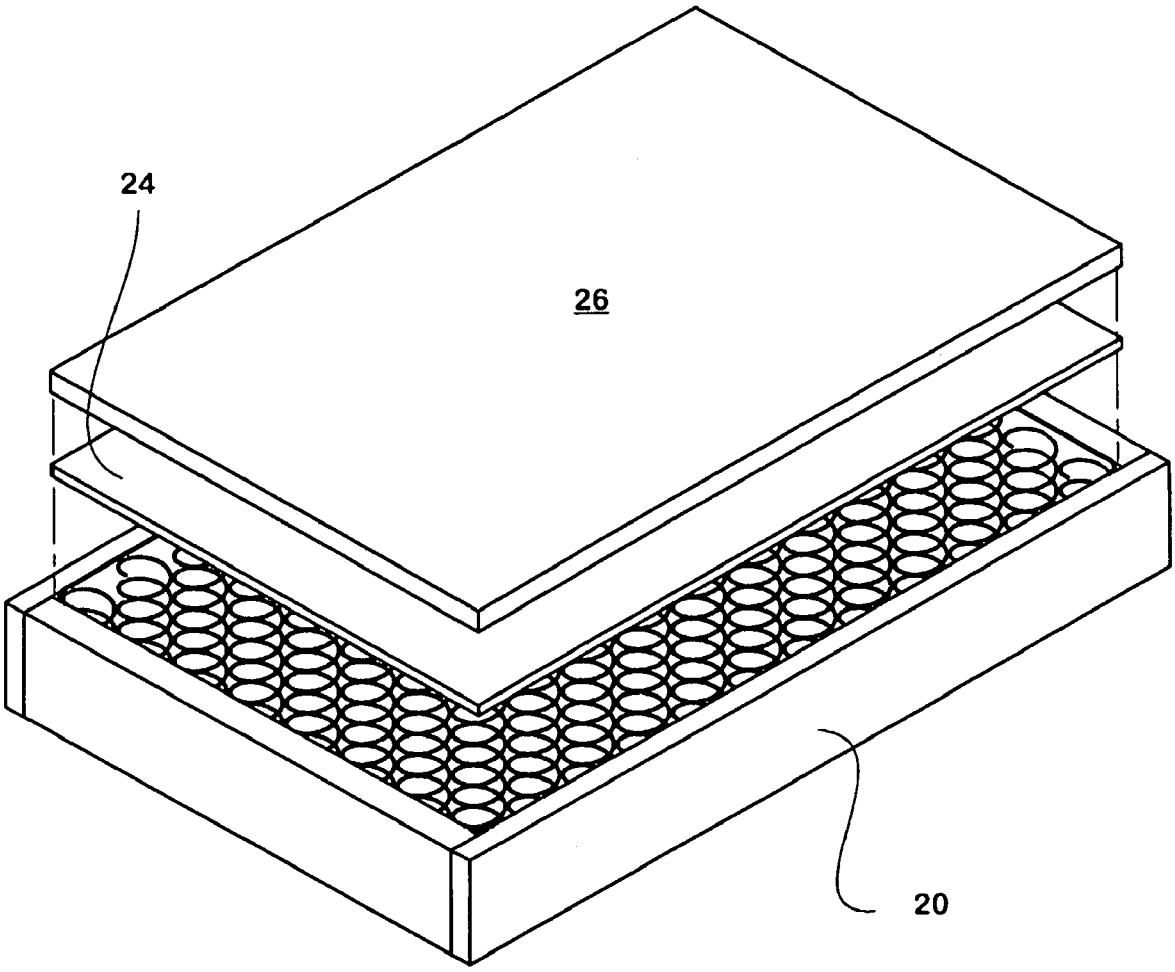
Figure 8:
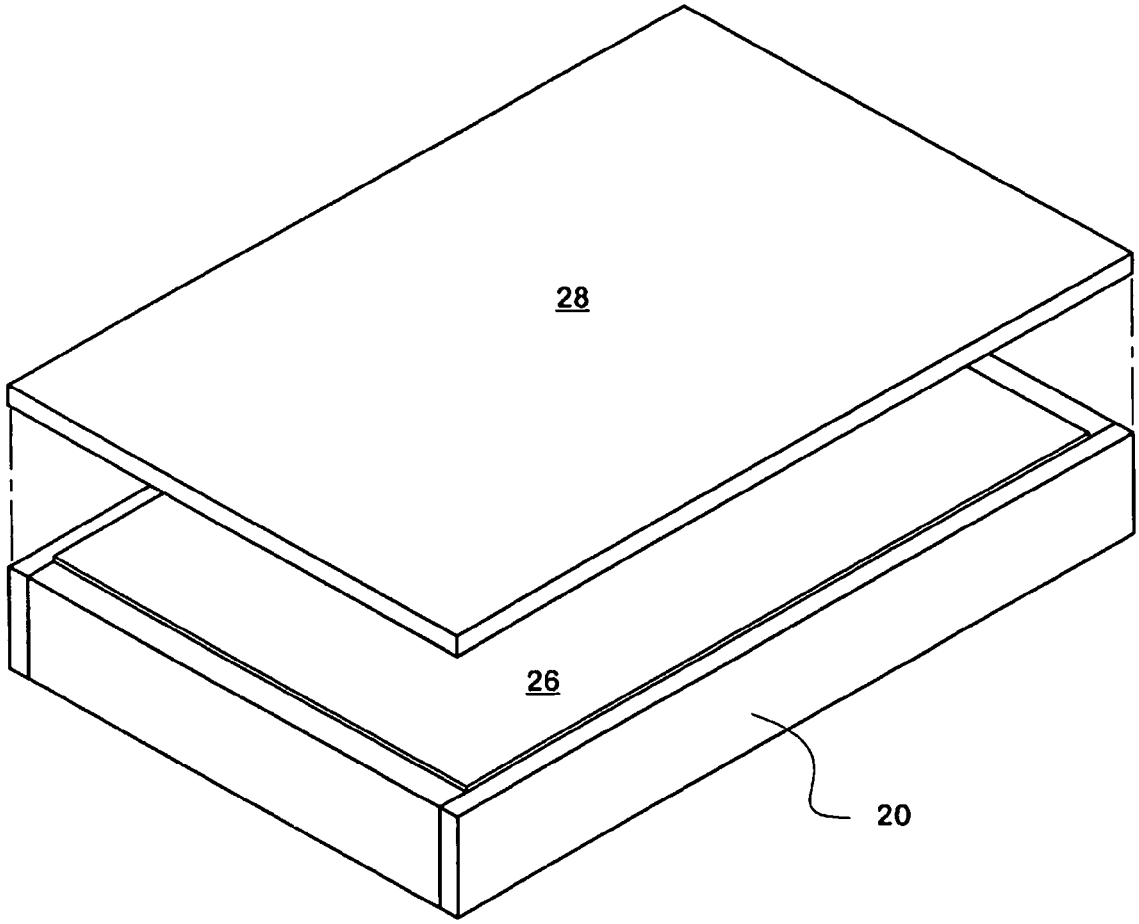

The tub 20 then inverted (FIG. 5). A mattress core unit 22 is now lowered (FIG. 6) into the tub. Next (FIG. 7), pieces of bonded fiber batting 24 such as "Flexatron" (a registered trademark of Kingsdown Incorporated) are placed on the top and bottom of the core, particularly where the core is an innerspring, to prevent damage from abrasion. A layer of foam insulation 26 sized to fit within the tub is then placed on top of the upper piece of batting. After that (FIG. 8), a top foam panel 28, sized to overlap the side and end rails, is adhered to the upper surfaces of the rails, completing the foam envelope. With judicious selection and combination of innerspring and insulation material, a desired mattress "feel" can be obtained.

In the single-sided mattress construction described above, all four foam rails overlap the edges of the bottom panel. This provides stronger support for the upper edge of the bed than would a construction in which the bottom panel overlapped the rails, as the top panel does.

The foam pieces may or may not have the same characteristics. For example, the side and end rails may have a greater firmness (be less compressible than) the top panel 28, to provide a firm mattress edge. For example, the rails may have an indentation load or force deflection (ILD) of 45 (the number of pounds required to produce a 25% compression of 50 square inches of a sample of standard thickness), whereas the top panel may have an ILD of 20. The exact firmness of the each piece is of course a matter of choice.

While it is possible to interconnect the foam parts with mechanical fasteners, we presently prefer to join them with an adhesive as described. Adhesives suitable for connecting foam parts are well known, and the selection of one of these is a matter of design choice. Our present preference is to use a latex adhesive.

Figure 9:
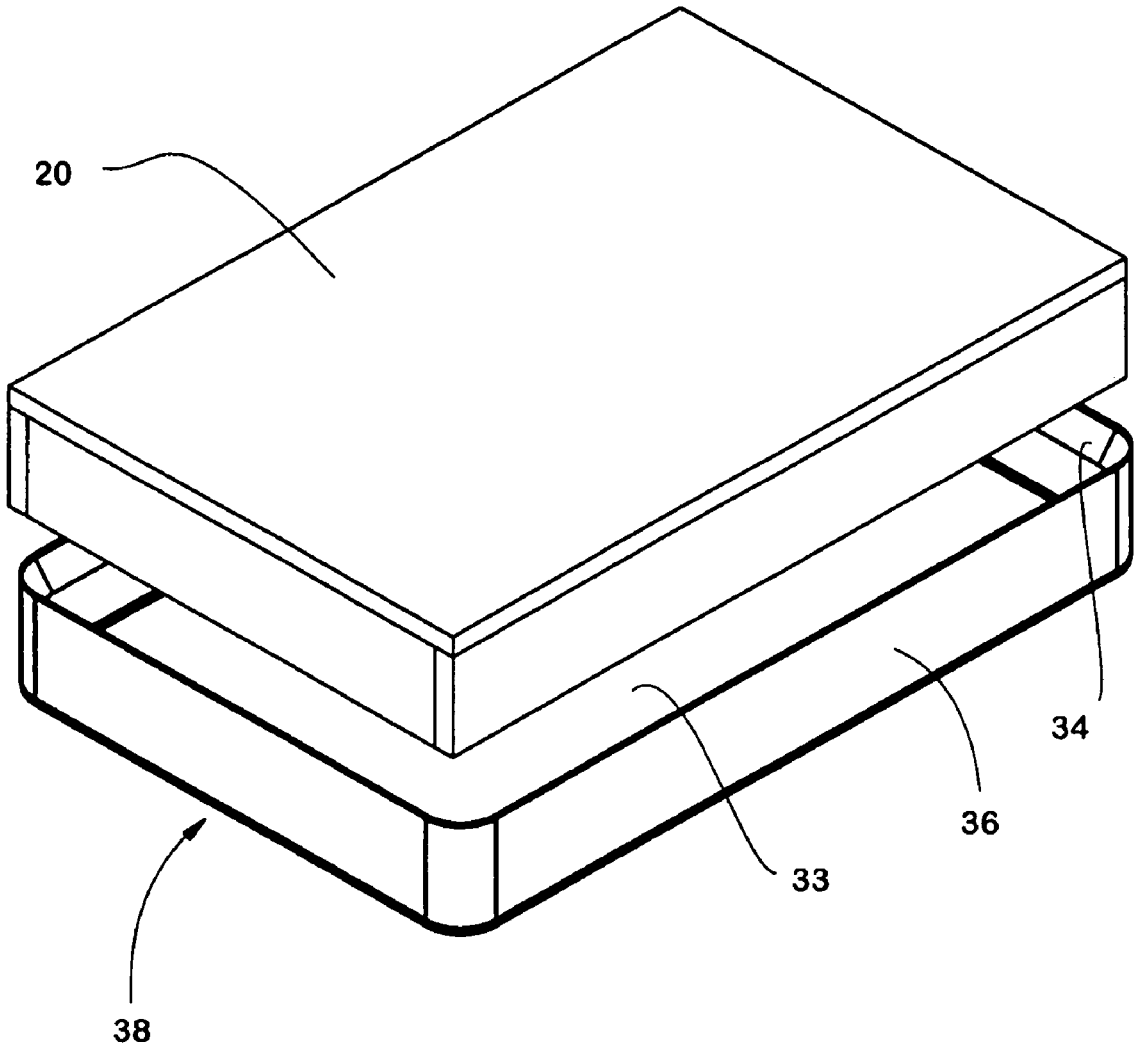

As an alternative, or adjunct, to adhesive connections, filamentary flexible fasteners of the type used to secure tags to garments may also be used to construct the envelope. Such fasteners are available in a variety of lengths and sizes, and can be easily inserted through foam layers with a needle-type installation gun. An example of such a fastener clip is disclosed in U.S. Pat. No. 3,733,657, particularly FIG. 9, which patent is incorporated herein by reference. The clip includes a plurality of fasteners, each comprising a flexible filament having a transverse cross-bar at one end thereof and a paddle a second transverse cross-bar at the opposite end. The transverse bar and the paddle (or second transverse bar) of each fastener extend in planes parallel to one another. The respective transverse bars are spaced apart and oriented side-by-side and parallel to one another. A runner bar extending perpendicular to the respective transverse bars is connected to each of the transverse bars by a readily severable bridge. The fasteners are inserted through the mattress material by an electric or pneumatic tagger gun, which has a hollow needle through which the cross-bar, temporarily aligned with the needle bore, passes. Once the fastener is inserted into or behind a piece of foam, and the needle is removed, the cross-bar swings back to its normal perpendicular position, preventing the fastener from pulling out.

However the pieces are assembled, the mattress core unit is completely encased in foam. The foam envelope is, in turn, ultimately enclosed by an attractive fabric covering which further stabilizes and slightly compresses the foam. The covering may include a previously constructed border band 30, a top cover 32, and a bottom cover 33.

Two different covering methods are described below. The first is for making a single-sided mattress, and the second is for making a reversible mattress.

To cover a single-sided mattress, a fabric border is formed by sewing a strong flange 34 (which may be a non-woven material) along or a short offset distance from one edge of a length of mattress border material. If the mattress is not to have a pillow top, the border material is about as wide as the mattress is high. The ends of the border material are sewn together to form a band 36. Then one edge of the band is sewn to the periphery of a bottom cover piece, forming a fabric tray 38, shown in FIG. 9.

Figure 10:
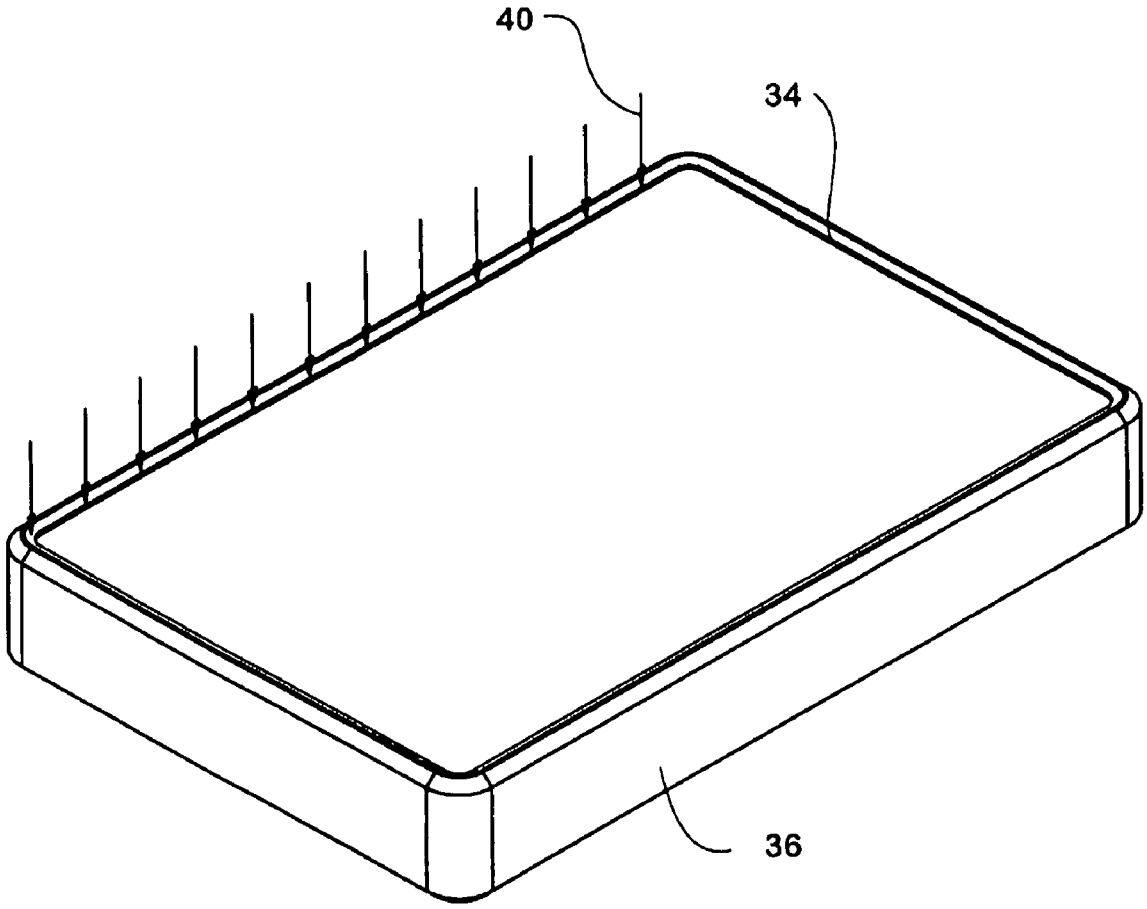

Now, as shown in FIG. 10, the foam envelope is inserted into the tray by pulling the border band over the foam envelope. The flange 34 is pulled inward across the top of the mattress to tension the tray as fasteners 40 are applied. The fasteners may be staples, be we presently prefer to use filamentary fasteners of the type described abovefor this purpose. The heads of the fasteners are inserted at intervals through the flange, down into the foam, while tension is maintained.

Figure 11:
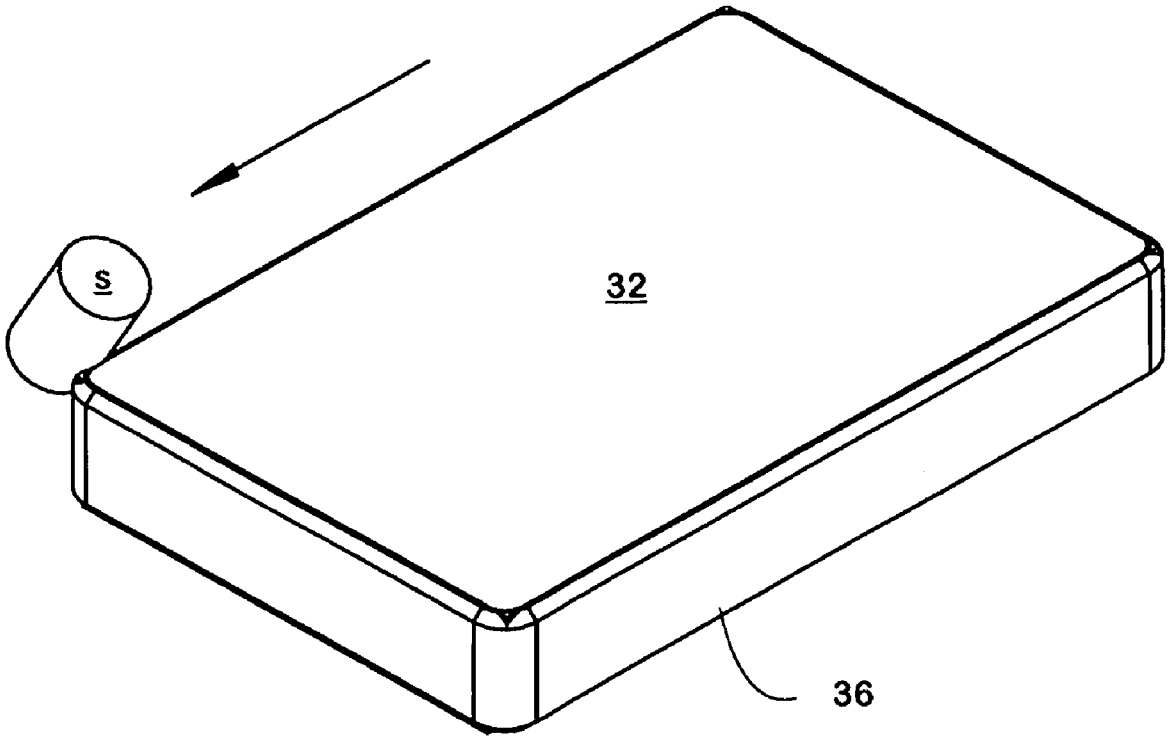

With the border band thus secured around the mattress, the top cover 32 may be applied. For a plain mattress top, the top cover is sewn directly to the upper edge of the border fabric, as shown in FIG. 11, preferably by a sewing machine "S" which applies a reinforcing tape over the seam that it forms. Machinery for performing these functions is well known.

Figure 12:
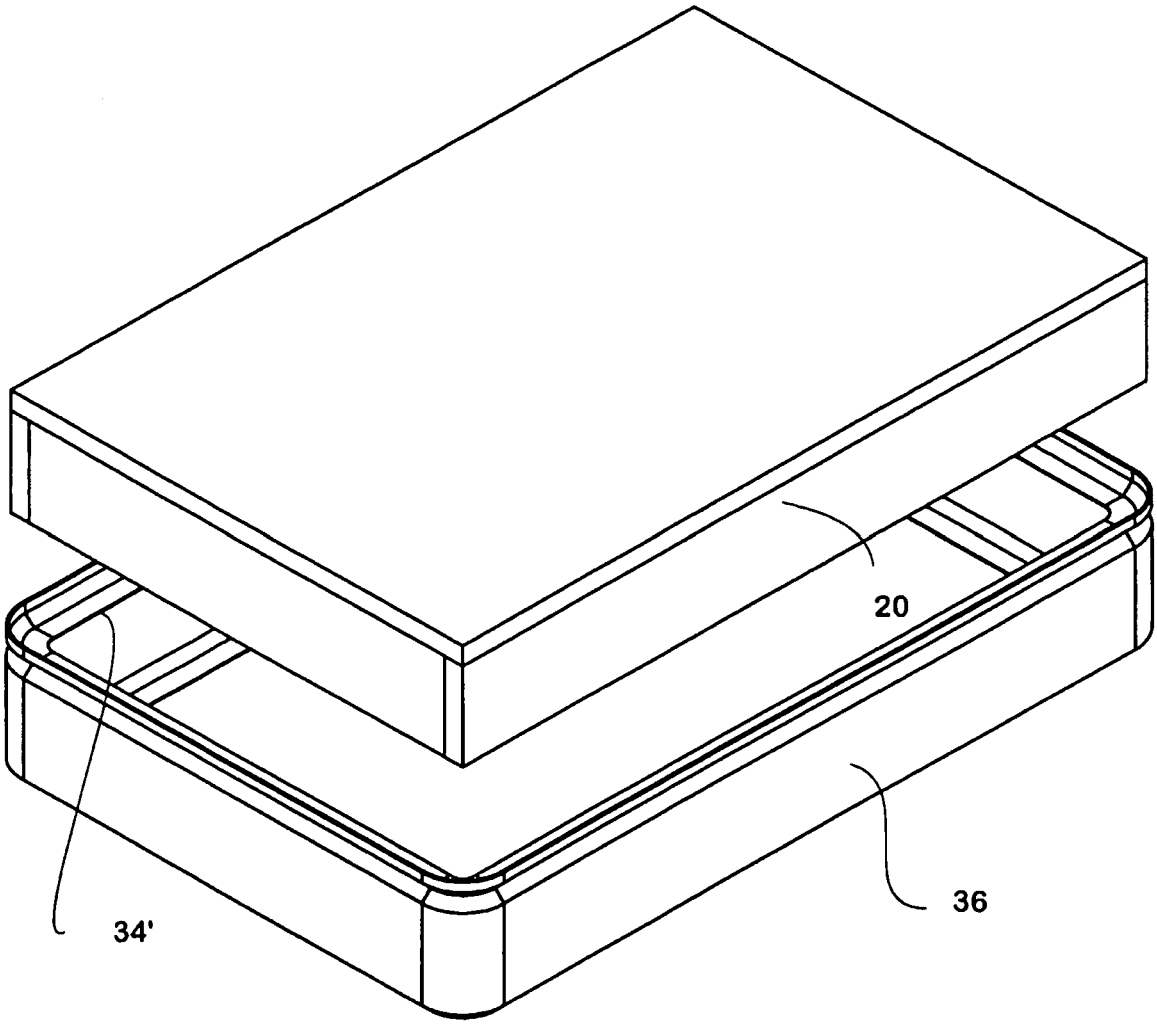
FIGS. 12-17 show steps of making a pillow top mattress. In particular.
Figure 13:
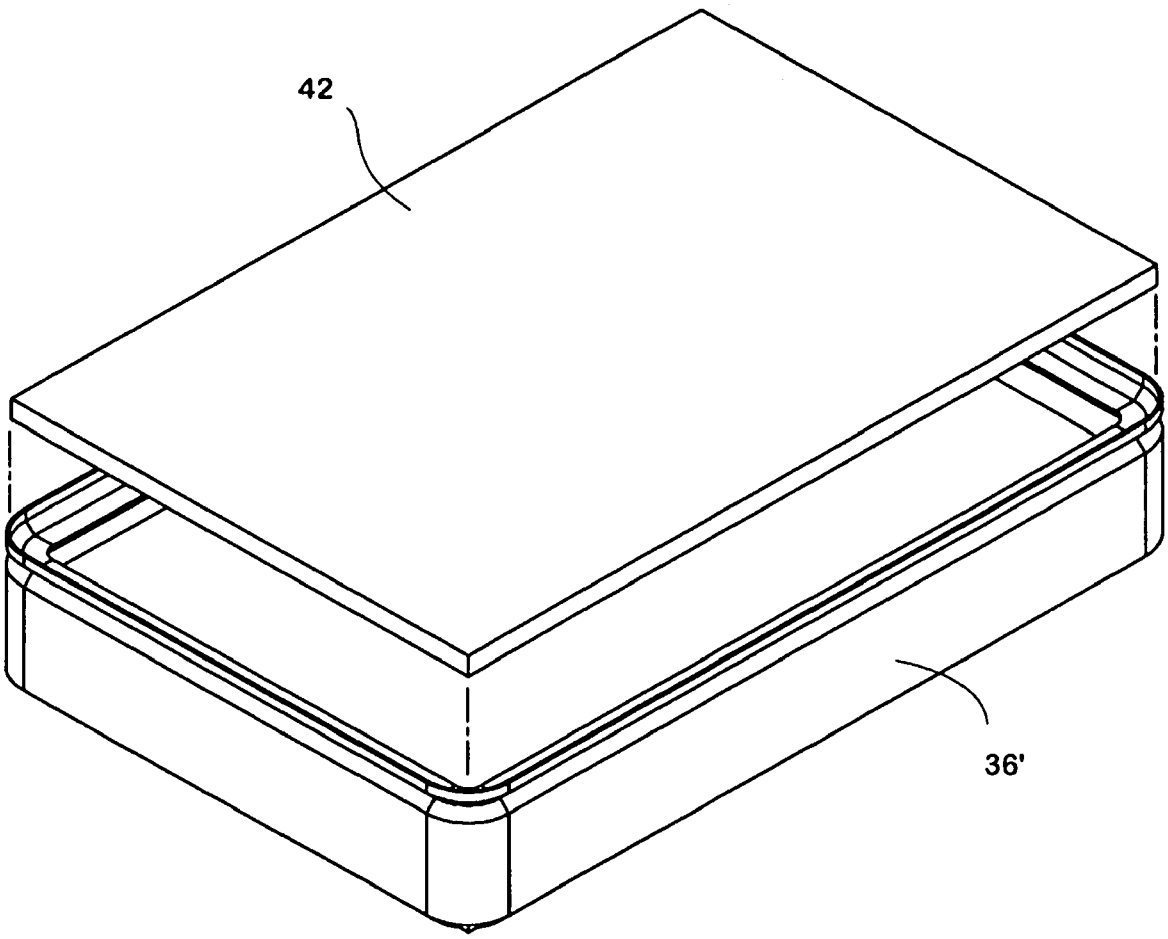

If a single pillow top is to be constructed, the border band 36' (FIG. 12) is mitered, before being installed, at appropriate intervals and the mitered edges are sewn together to define what will be the pillow top corners. A non-woven flange 34' is sewn to the border material along a line representing the junction between the mattress and the pillow top. The tray 38' formed by the band and the bottom cover are pulled up over the foam envelope so that the flange extends inward over the top surface of the foam envelope. Staples or filamentary fasteners (not shown) are driven through the flange material into or through the foam envelope, to hold the band in place. Pillow insulation 42 (FIG. 13) is now applied to the top of the mattress assembly. The pillow insulation may be a single piece, or it be assembled from plural pieces laid edgewise. For example, the pillow top insulation could have a relative soft center portion and a firmer marginal portion. Finally, a quilted fabric pillow cover 32 is sewn (FIG. 14) to the free edge of the band, with a tape-inserting sewing machine, to enclose the insulation and complete the pillow.

Figure 15:
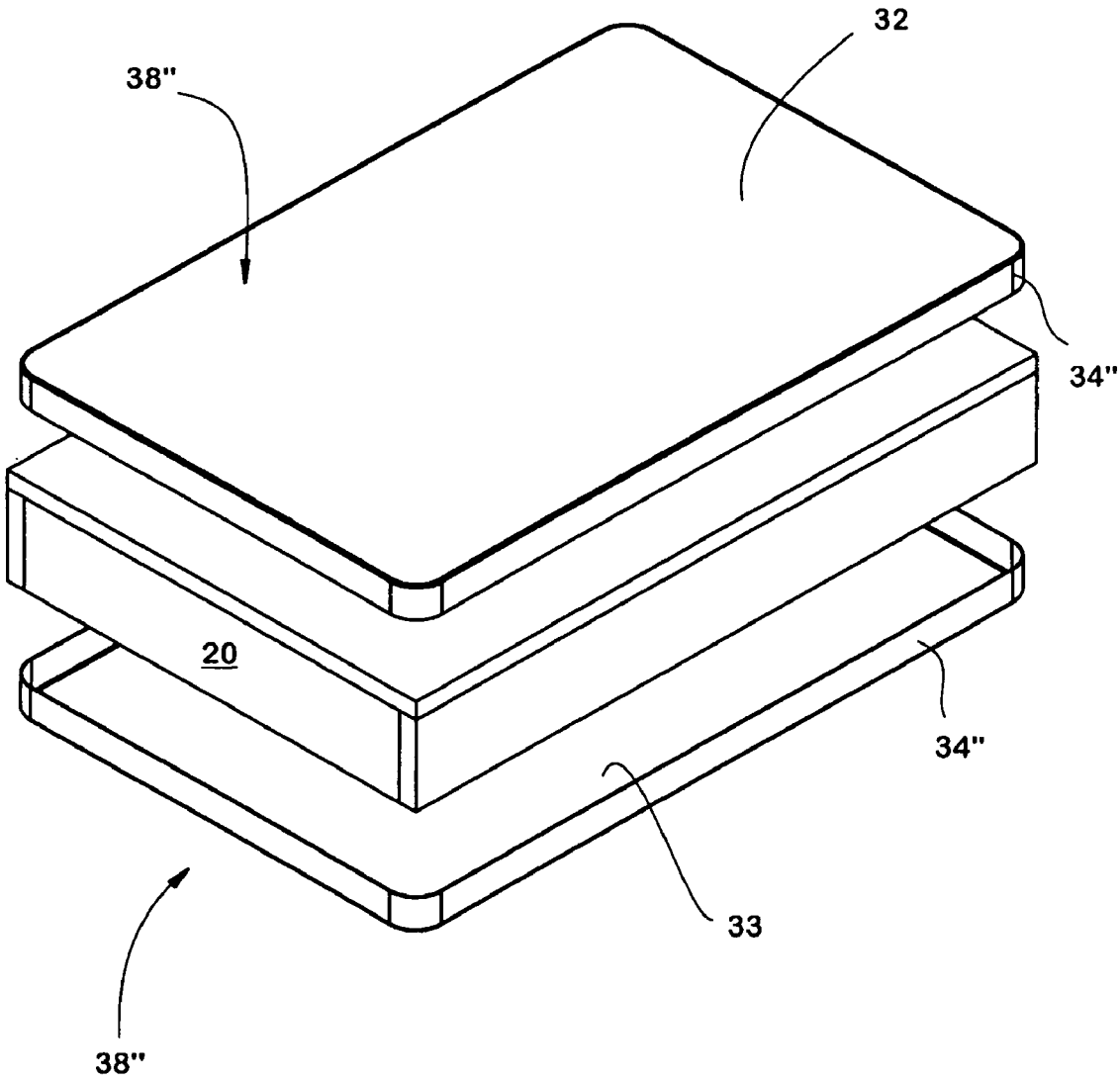
Figure 16:
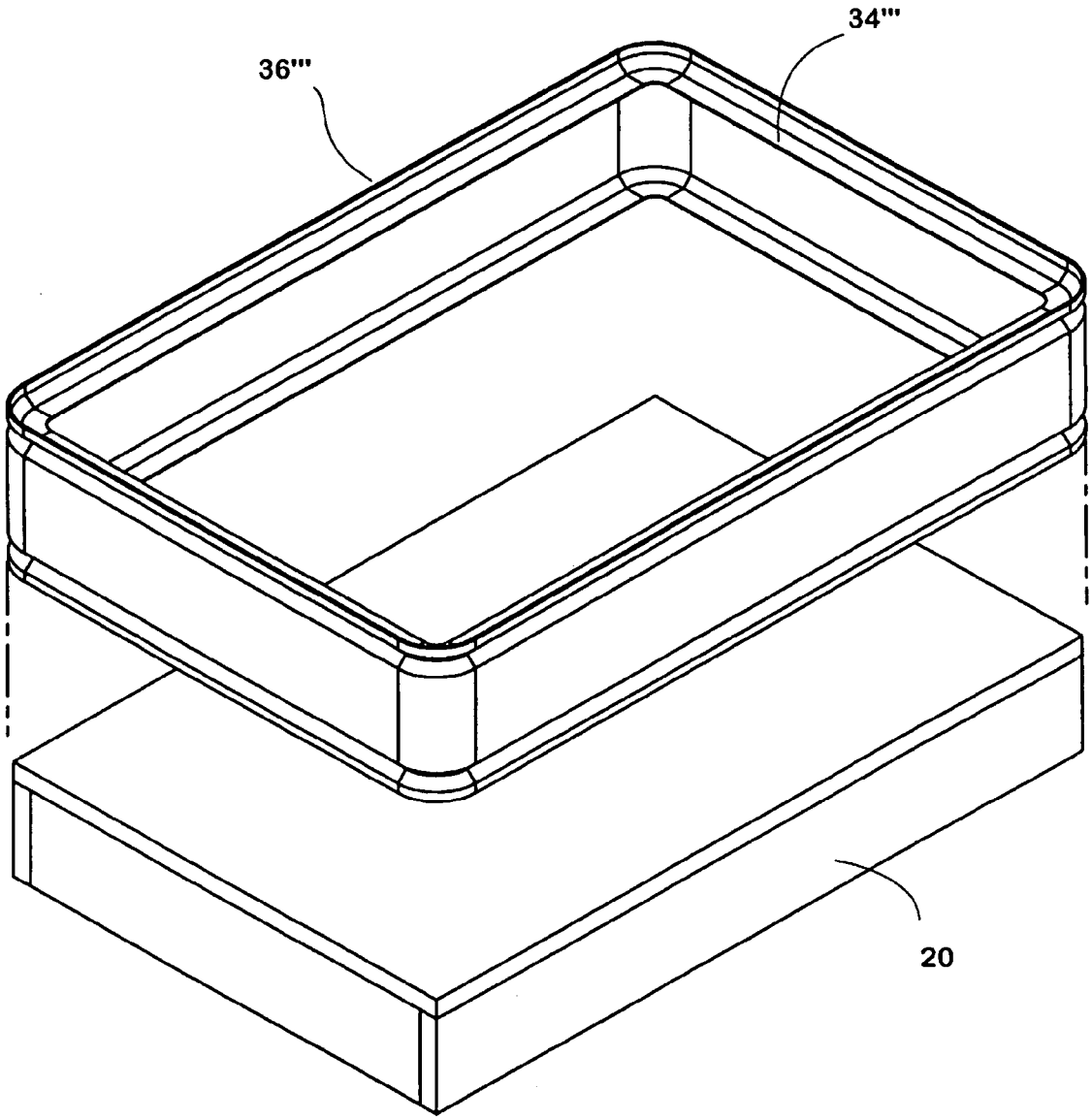

To make a reversible mattress, the bottom cover is not pre-attached to the border band. If the mattress is not to have pillow tops, a non-woven flange strip 34" is sewn to each of the top and bottom covers, forming shallow trays 38" that are pulled over the top and bottom of the foam envelope and secured thereto with suitable fasteners 40, as shown in FIG. 15. Now the border band 36" is pulled over the mattress (FIG. 16), and sewn to the top and bottom covers by machinery as described above.

Figure 14:
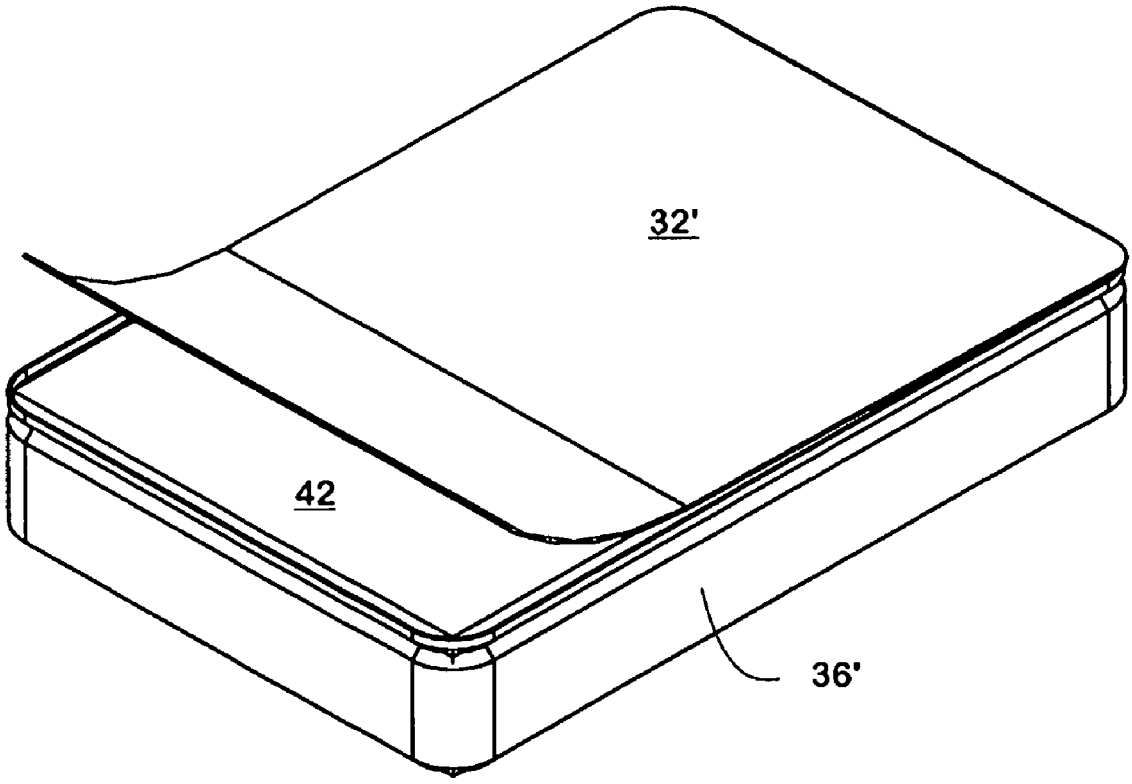
Figure 17:
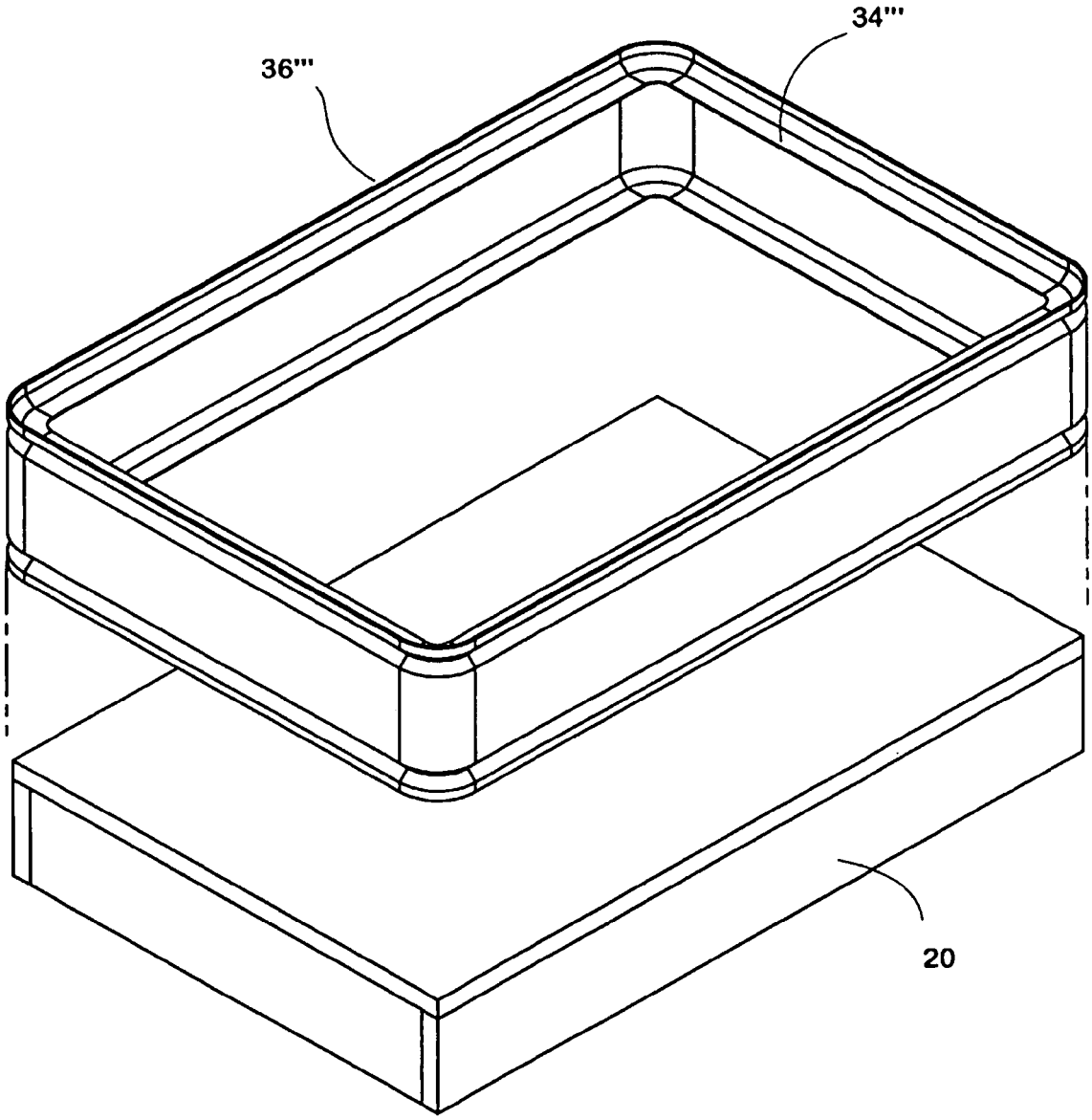

If the reversible mattress is to have pillow tops, then a band 36'" of greater width, mitered and sewn on both edges to form what will be corners of the pillow top, is pulled over the mattress. The band, shown in FIG. 17, has two flange strips 34'" attached along its length, so that it may be pulled into place and attached to the both the top and bottom of the foam envelope as described previously. Finally, each pillow top is completed by adding pillow top insulation and then closing the pillow top by sewing on the pillow top cover, substantially as shown in FIG. 14.

In the foam envelope construction described above, which we term "full body surround", the bottom panel is sized to fit within the foam wall, while the top foam panel overlaps the wall. This construction provides a desirably firm upper edge, and is particularly suitable for making a one-sided mattress.

Figure 18:
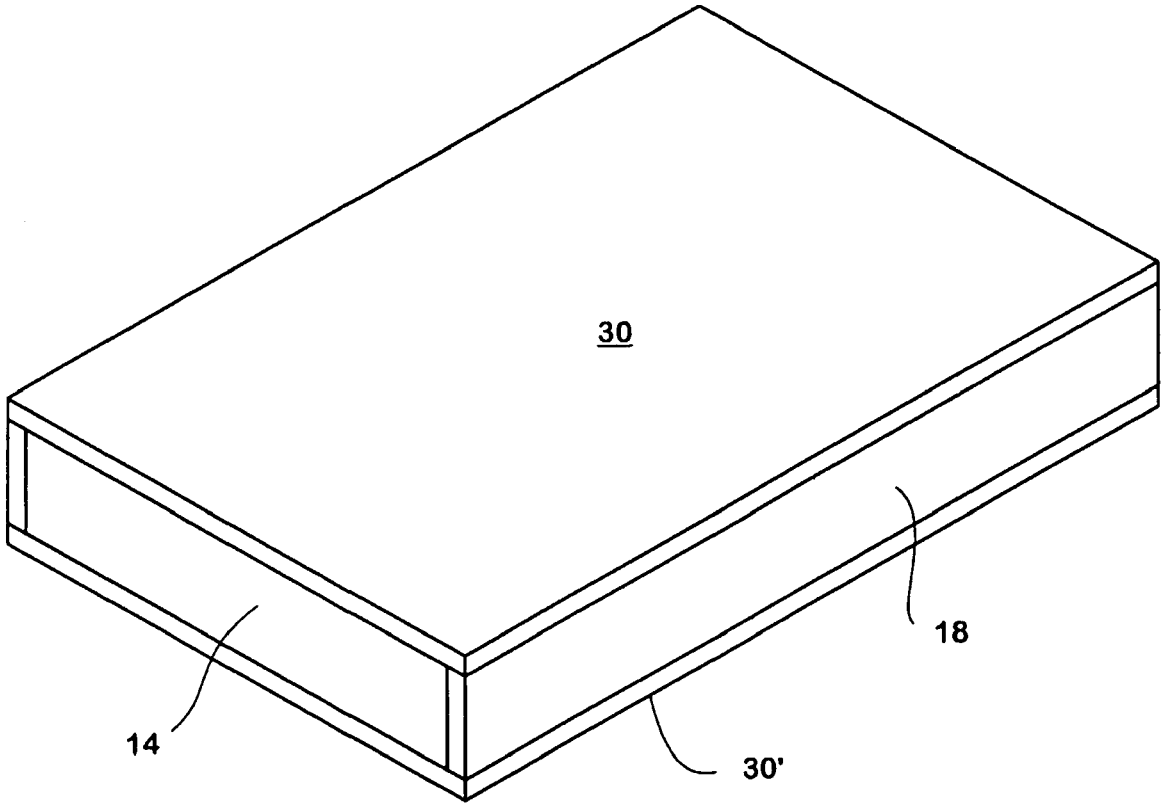
FIG. 18 shows an alternative form of the mattress construction.

In contrast, FIG. 18 shows an alternative "dual surround" construction, which may be used to produce a reversible mattress. As with the embodiment of FIGS. 1-14, a foam wall encloses the mattress core unit but here, unlike the first embodiment, both the top and bottom foam panels overlap the wall, rather than being contained within it. The construction shown in FIG. 18 is eventually covered top and bottom with a fabric or quilted fabric laminate, in a manner similar to that described above.

In either embodiment, the rails preferably are dimensioned so that the mattress core unit and its insulation have a combined height somewhat greater than the depth of the envelope cavity. This gives the mattress a slight crown, which prevents an appearance of sagging.

The non-woven flanges described above may not be necessary in every case, although they do provide a convenient hand-hold for the installer. Particularly in the case of a pillow-top mattress, the band material itself may be drawn inward over the top surface of the foam envelope far enough to be fastened directly to the foam. In these cases, it may be possible to eliminate the flange(s).

With suitable modification, the principles of this invention may be applied as well to motion bedding (mattresses which can be flexed, for example for adjustable beds). A mattress core unit must be selected which is designed to flex repeatedly, and the thickness and firmness of the foam components may be appropriately changed.

While a mattress construction using foam components is described above, it should be understood that other resilient materials suitable for mattress construction, know known or yet to be invented, may be appropriate for use with this invention. Therefore, the claims that follow describe the material as resilient. Foam is a species of resilient material, and currently is the most preferred.

It should be understood that additional materials, features and components, other than those described above may be included in the construction, but such additional items are not important to the invention now claimed.

Since the invention is subject to modifications and variations, it is intended that the foregoing description and the accompanying drawings shall be interpreted as only illustrative of the invention defined by the following claims.

I claim:

1. A method of making a mattress, said method comprising steps of constructing a resilient tub having a peripheral resilient wall and a resilient bottom panel by permanently connecting two resilient end rails and two resilient side rails to the bottom panel along the periphery thereof, inserting a mattress core unit into the envelope, permanently connecting a top resilient panel to the top periphery of the wall to completely enclose the mattress core unit in a resilient envelope, and applying a fabric covering over the resilient envelope, wherein said applying step comprises steps of forming a band of border material, attaching a bottom fabric cover to the lower edge of the border band by sewing the periphery of the bottom cover to one edge of the border band, thereby forming a fabric tray, and then pulling the fabric tray over the resilient envelope so that the border band surrounds the resilient wall, securing the fabric tray to the resilient envelope, and then attaching a top fabric cover to the border band by sewing the periphery of the top cover to the top edge of the border band.

2. The method of claim 1, wherein the forming step includes a step of attaching a flange strip near one edge of the border band and the securing step consists of attaching the flange strip to the resilient envelope.

3. The method of claim 1, wherein the border band is mitered and sewn at intervals to define pillow top corners along its upper edge, and after the tray is pulled over the resilient envelope, the border band is secured to the resilient envelope, pillow top insulation is applied to the top of the resilient envelope, and the pillow top is closed by said attaching step.

4. The method of claim 1, wherein the fabric covering comprises a top cover having a flange piece sewn around its periphery, and the applying step comprises steps of fastening the flange piece to one of the resilient rails, pulling the flange piece to maintain tension in the top panel and fastening the flange piece to the other resilient rails while maintaining said tension.

5. The method of claim 4, comprising further steps of applying a fabric border around said rails and sewing the border to the top panel.

6. A method of making a mattress, said method comprising steps of constructing a resilient tub having a peripheral resilient wall and a resilient bottom panel by permanently connecting two resilient end rails and two resilient side rails to the bottom panel along the periphery thereof, inserting a mattress core unit into the envelope, permanently connecting a top resilient panel to the top periphery of the wall to completely enclose the mattress core unit in a resilient envelope, and applying a fabric covering over the resilient envelope, wherein the step of applying a fabric covering includes steps of forming a border band of fabric material, said band having pillow top corners preformed therein, pulling the border band over the resilient envelope, applying pillow top insulation to one face of the resilient envelope within the border band, and then sewing a pillow top cover to the periphery of the band, thereby enclosing the pillow top insulation to form a pillow top.

7. The method of claim 6, wherein said pillow top insulation comprises plural pieces of insulation having different firmness.

8. The method of claim 7, wherein the pillow top insulation has a central portion of a first firmness and a marginal portion of a second, greater firmness.

9. The method of claim 6, wherein the band is provided with a nonwoven flange strip, and further comprising a step of fastening the flange strip to the resilient envelope.

10. The method of claim 9, wherein the flange strip is fastened to the resilient envelope by driving filamentary fasteners through the fabric into the resilient envelope.

* * * * *